US011318342B2

(12) United States Patent
Hsieh

(10) Patent No.: US 11,318,342 B2
(45) Date of Patent: May 3, 2022

(54) MINI STEPPER WITH FLAT STEPS

(71) Applicant: Paul Hsieh, City of Industry, CA (US)

(72) Inventor: Paul Hsieh, City of Industry, CA (US)

(73) Assignee: Paradigm Health and Wellness, City of Industry, CA (US)

( * ) Notice: Subject to any disclaimer, the term of this patent is extended or adjusted under 35 U.S.C. 154(b) by 69 days.

(21) Appl. No.: 16/824,701

(22) Filed: Mar. 20, 2020

(65) Prior Publication Data

US 2020/0298042 A1 Sep. 24, 2020

Related U.S. Application Data

(60) Provisional application No. 62/821,151, filed on Mar. 20, 2019.

(51) Int. Cl.
*A63B 21/008* (2006.01)
*A63B 21/00* (2006.01)

(52) U.S. Cl.
CPC ..... *A63B 21/0083* (2013.01); *A63B 21/4034* (2015.10); *A63B 21/4047* (2015.10); *A63B 21/00069* (2013.01); *A63B 2208/0204* (2013.01)

(58) Field of Classification Search
CPC ..... A63B 21/0083; A63B 21/4047; A63B 21/4034; A63B 2208/0204; A63B 21/00069; A63B 22/0056; A63B 71/0622; A63B 2225/20; A63B 2230/06; A63B 2225/093; A63B 2220/17
See application file for complete search history.

(56) References Cited

U.S. PATENT DOCUMENTS

D281,343 S 11/1985 Krive
5,199,932 A * 4/1993 Liao ..... A63B 22/001 482/37
5,199,933 A * 4/1993 Illuzzi ..... A63B 22/0605 482/62
5,230,675 A * 7/1993 Lin ..... A63B 22/0056 482/80
5,232,421 A * 8/1993 Chen ..... A63B 22/0056 482/53
5,256,117 A * 10/1993 Potts ..... A63B 21/157 482/52
5,256,118 A * 10/1993 Chen ..... A63B 22/0056 482/80

(Continued)

*Primary Examiner* — Garrett K Atkinson
(74) *Attorney, Agent, or Firm* — Kirk A. Buhler; Buhler & Associates Patenting

(57) ABSTRACT

Improvements in a transportable stepper are disclosed. The mini stepper has steps that remain horizontal through the entire stroke. The mini stepper uses parallel connected arms to maintain flat steps so a user steps in a natural position and maintain a balanced posture. The stepper has a step height adjustment that links the two pedals. The travel or highest position for the foot pads is adjustable to change the resistance or work-out intensity for the user by limiting the vertical travel for the foot pads and links the foot pads to ensure when one footpad is being pushed downward, the opposing footpad is being elevated. The resistance pistons are surrounded by an insulation tube that minimizes skin contact to hot pistons. The mini stepper has a display that links to an application for tracking/displaying exercise related information.

20 Claims, 5 Drawing Sheets

(56) References Cited

U.S. PATENT DOCUMENTS 5,277,677 A * 1/1994 Terauds ..... A63B 22/0056 482/80
5,284,461 A * 2/1994 Wilkinson ..... A63B 22/14 482/53
5,290,211 A * 3/1994 Stearns ..... A63B 21/00178 482/53
5,298,002 A * 3/1994 Lin ..... A63B 22/0058 482/79
D348,708 S * 7/1994 Chen ..... D21/685
D349,542 S 8/1994 Russell
5,407,407 A 4/1995 Lin
5,453,065 A * 9/1995 Lien ..... A63B 22/0056 482/52
5,505,678 A * 4/1996 Johnston ..... A63B 21/00178 482/52
5,569,127 A * 10/1996 Johnston ..... A63B 21/00178 482/52
5,595,554 A * 1/1997 Maresh ..... A63B 21/157 482/52
5,628,709 A * 5/1997 Chen ..... A63B 22/0064 482/53
5,676,623 A * 10/1997 Yu ..... A63B 22/0056 482/53
5,766,113 A * 6/1998 Rodgers, Jr. ..... A63B 22/0664 482/52
5,807,210 A * 9/1998 Devlin ..... A63B 22/0056 482/52
5,865,712 A * 2/1999 Chang ..... A63B 22/0664 482/52
5,879,276 A * 3/1999 Miller ..... A63B 22/18 482/131
D461,211 S 8/2002 Kuo
D465,001 S 10/2002 Chiang-Chow
D466,567 S 12/2002 Chen et al.
6,582,344 B2 * 6/2003 Tang ..... A63B 21/068 482/52
D481,085 S * 10/2003 Ben-Moshe ..... D21/668
6,709,368 B1 * 3/2004 Chue ..... A63B 21/015 482/52
D496,700 S 9/2004 Chen
6,830,539 B2 * 12/2004 Chuang ..... A63B 22/0056 482/52
6,918,857 B2 * 7/2005 Chen ..... A63B 22/0056 482/53
6,949,054 B1 * 9/2005 Stearns ..... A63B 22/0664 482/52
D514,635 S 2/2006 Hsiao
D519,583 S 4/2006 Chen
7,658,698 B2 * 2/2010 Pacheco ..... A63B 21/157 482/52
8,277,366 B2 10/2012 Savane
D684,222 S 6/2013 Kim
10,315,069 B1 * 6/2019 Maresh ..... A63B 23/03575
10,328,302 B2 * 6/2019 Yeh ..... A63B 22/0056
10,328,305 B1 * 6/2019 Maresh ..... A63B 22/0005
10,518,124 B2 * 12/2019 Johnston ..... A63B 22/0056
2003/0216223 A1 * 11/2003 Chuang ..... A63B 23/0429 482/53
2005/0064996 A1 * 3/2005 Chen ..... A63B 22/0056 482/53
2005/0070403 A1 * 3/2005 Yu ..... A63B 21/0083 482/53
2005/0227818 A1 * 10/2005 Liao ..... A63B 22/0069 482/53
2006/0019801 A1 * 1/2006 Zeng ..... A63B 22/0064 482/52
2006/0229166 A1 * 10/2006 Fan ..... A63B 23/03575 482/53
2008/0032869 A1 * 2/2008 Pacheco ..... A63B 22/205 482/52
2019/0308063 A1 * 10/2019 Johnston ..... A63B 21/0083
2020/0206564 A1 * 7/2020 Johnston ..... A63B 21/151

* cited by examiner

MINI STEPPER WITH FLAT STEPS

CROSS REFERENCE TO RELATED APPLICATIONS

This application claims the benefit of Provisional Application Ser. No. 62/821,151 filed Mar. 20, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a compact stepper. More particularly, the present mini stepper with flat steps allows a user to exercise on a compact transportable stepper with foot pads that remain parallel and do not pivot on the rotating arms.

Description of Related Art Including Information Disclosed Under 37 CFR 1.97 and 1.98

Stepping machines are a fairly common form of exercise. Stepping machines can be fairly large in size to allow a user to stand upright and hold onto handrails. Compact or mini steppers allow a user to perform the exercise on a stepper that is easily transportable and can be stored under a desk or bed. Prior art mini steppers have footpads that pivot from a single axle or axis and because of this configuration, the angle of the footpads change from flat to an elevated position and require the user to step in an unnatural manner.

A number of patents and or publications have been made to address these issues. Exemplary examples of patents and or publication that try to address this/these problem(s) are identified and discussed below.

U.S. Pat. No. 5,232,421 issued on Aug. 3, 1993 to Jin-Liang Chen et al., and is titled Stepper. This patent discloses a stepper with a base frame, two swing arms, two hydraulic cylinders and an adjustment assembly. Each of the swing arms is mounted pivotally on the base frame at one end and carries a pedal on the other end. The adjustment assembly is disposed on the base frame and permits adjustments in the angular displacement of the pedals. Both pedals pivot from arms that change the angle of the pedal and any foot on the pedal. This makes the user foot move in unnatural angles as the user steps.

U.S. Pat. No. 5,277,677 issued on Jan. 11, 1994 to Juris Teraudsin-Liang Chen et al., and is titled Stepping Exercise Machine. This patent discloses an exercise machine is provided that includes two stepping platforms pivotally interconnected to a frame. The stepping platforms are moved in a substantially vertical direction by the application of forces during the stepping motion by the user. The applied forces are resisted by fluidic cylinders. A rocker assembly is used to raise one of the stepping platforms while the other stepping platform is moved downwardly. A pair of lifter elements interconnects the stepping platforms with the rocker assembly. The ends of the lifter elements pivotally move during the vertical movement of the stepping platforms. While the rocker lifts opposing pedals the angle of the pedal still changes as the ends of the pedals elevate.

U.S. Pat. No. 6,709,368 issued on Mar. 23, 2004 to Lap Fu Chue and is titled Foot Exercise Device. This patent discloses two pedals that move in opposition to one another as one foot presses down, while the other is pushed up, the device is placed under your feet while sitting in a chair. By turning clockwise, a resistance dial located on a stein, resistance is adjustable by the user. Mechanism of resistance is provided by opposition against two arc shaped wedges offset by an angle resulting in one pedal rising as the other falls. The straight axle in the back is connected to the curved axle in the front by a central housing on top of which is positioned the resistance dial. While this patent discloses a variable resistance, it does not address the unnatural articulation of the pedals.

What is needed is a mini stepping exercise apparatus that uses a four-bar linkage arm structure on each foot pad to maintain the footpads in a natural horizontal relationship as the pedals move up and down. The proposed mini stepper with flat steps in this disclosure provides the solution in a low profile easily transported stepper.

BRIEF SUMMARY OF THE INVENTION

It is an object of the mini stepper with flat steps to be a compact design that can be easily transported and stored. The overall height of the stepper allows the mini stepper to be stored under a desk or bed when not being used. The stepper can easily transported by a user.

It is another object of the mini stepper with flat steps to maintain the steps in a horizontal relationship as the pedals move from an upper to a lower position. Maintaining a horizontal relationship on the pedals allows a user to step in a natural position as they might in ascending actual stairs. The horizontal relationship also allows the user to maintain a balanced position while on the stepper. The step platforms follow an arc translation from an upper to a lower position over a supporting base. This translational arc follows a more natural motion of going up steps. The bottom travel of each foot pad is controlled with a cushioned stop where a foot pad support contacts the frame of the stepper.

It is another object of the mini stepper with flat steps for the horizontal relationship to be maintained through two separate sets of rotation axis. Each foot pad is supported on two separate sets of support arms. The support arms pivot through the base and through their respective foot pad.

It is another object of the mini stepper with flat steps to have an adjustment that limits the maximum height the steps can elevate. The step height adjustment is with a link between the two pedals. The travel or highest position for the foot pads is adjustable to change the resistance or work-out intensity for the user. A user adjustment changes or limits the maximum vertical travel for the foot pads and also links the foot pads to ensure that as one foot pad is being pushed downward, the opposing footpad is being elevated.

It is another object of the mini stepper with flat steps to utilize resistance pistons under each pedal to provide a resistance to exercise. The pistons are surrounded by an insulation tube that minimizes skin contact to the resistance pistons. The insulation provides an additional layer of protection to prevent a user from physical contact with the pistons and also includes venting holes for cooling of the pistons.

It is still another object of the mini stepper with flat steps to include a display that counts step, floors, time, calories burned and other exercise related information. The display is easily visible to a user when they exercise and also includes a wireless link to an application that can store or control the workout from a phone, tablet, computer or watch. The display can also include heart rate monitoring information.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
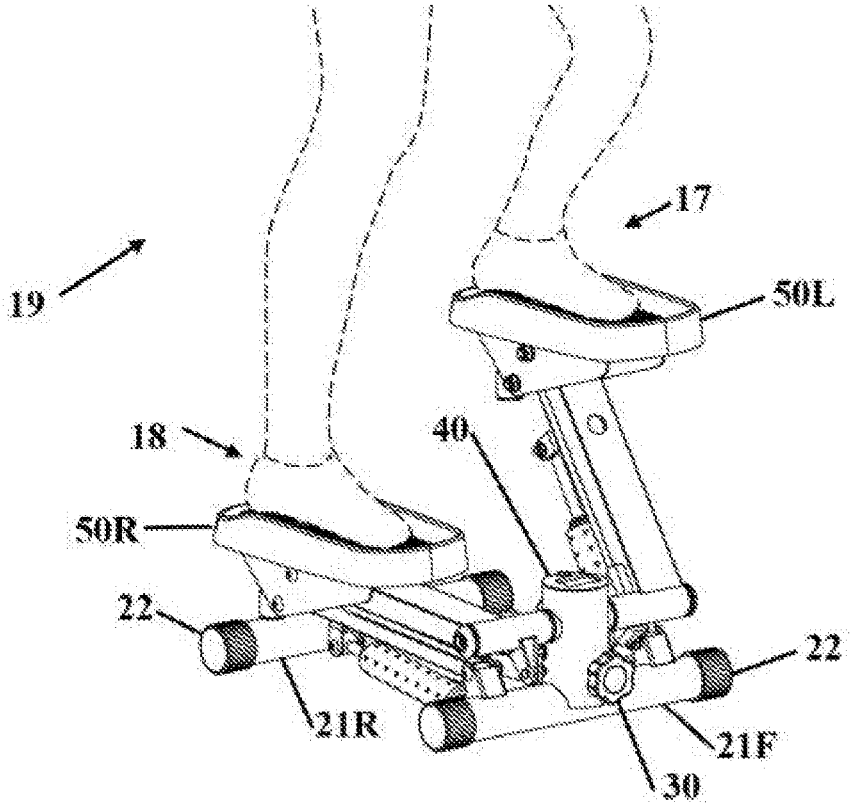
FIG. 1 shows a user on a mini stepper with flat steps.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

Item Numbers and Description

| | | | |
|---|---|---|---|
| 17 | left foot | 18 | right foot |
| 19 | user | 20 | mini stepper |
| 21L | front frame tube | 21R | rear frame tube |
| 22 | end cap | 23 | central tube |
| 24 | cushion | 30 | resistance control |
| 31 | threaded tube | 32 | pull/push shaft |
| 33 | "U" bracket | 34 | pivot bracket |
| 35 | slot | 36 | pivot shaft |
| 37 | bushing/bearing | 38 | threads |
| 39 | sensor | 40 | display housing |
| 41 | display | 42 | button |

-continued

| | | | |
|---|---|---|---|
| 50L | left footpad | 50R | right footpad |
| 51 | elevated rim | 52 | textured pad |
| 53L | upper left support tube | 53R | upper right support tube |
| 54L | left pivot tube | 54R | right pivot tube |
| 55L | left footpad support | 55R | right footpad support |
| 56L | left travel stop tube | 56R | right travel stop tube |
| 57 | shaft | 57L | pivot shaft |
| 57R | pivot shaft | 58L | left control arm |
| 58R | right control arm | 60L | left piston rod |
| 60R | right piston rod | 61L | left piston |
| 61R | right piston | 62L | left piston shield |
| 62R | right piston shield | 63L/R-69L/R | pivot(s)/bushing(s) |
| 70 | parallel spacing | 71L | lower level |
| 71R | upper level | 72L | left bracket |
| 73L | link | 73R | link |
| 74L | left bracket | 75R | right bracket |
| 90 | Alt Piston | 91 | Alt Piston |
| 95 | in | 96 | out |
| 97 | move | 98 | rotate |
| 99 | step arc | | |

Figure 2:
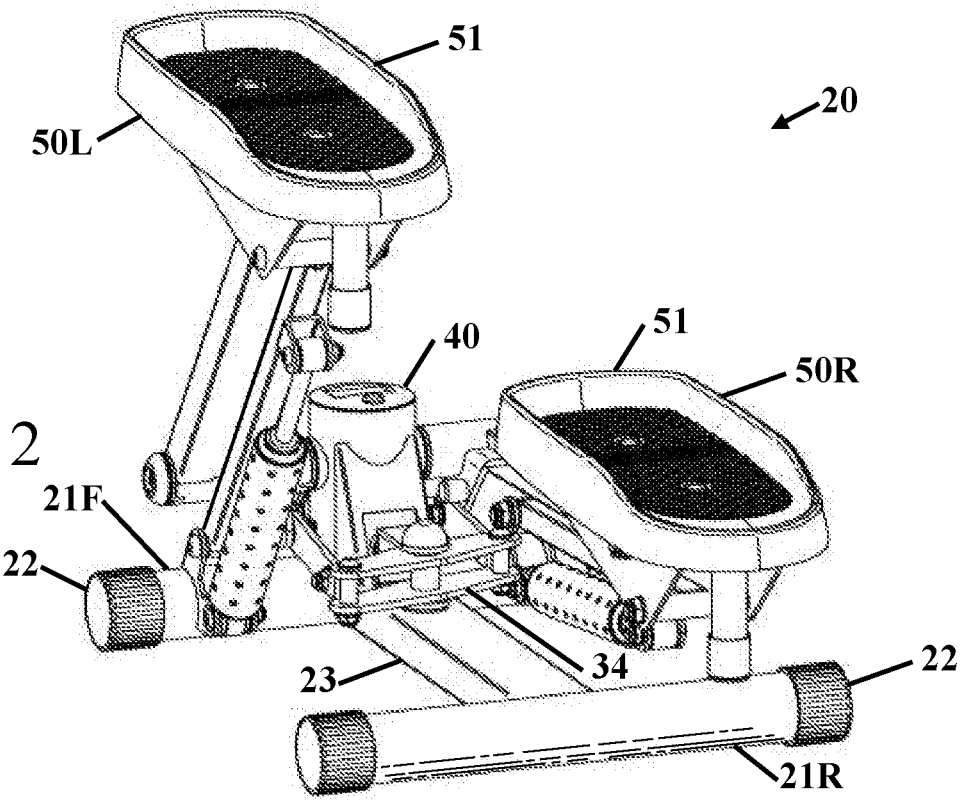
FIG. 2 shows a rear perspective view of the mini stepper.

FIG. 1 shows a user on a mini stepper 20 with flat steps and FIG. 2 shows a rear perspective view of the mini stepper 20. When exercising a user 19 will place a right foot 18 on the right foot pad 50R and their other foot 17 on the left foot pad 50L. In this figure, the user's right foot 18 is shown on the right foot pad 50R and the user's left foot 17 on the left foot pad 50L. It is also contemplated that the user can use the mini stepper 20 in an opposing orientation where feet are placed on opposing foot pads. Each foot pad 50R and 50L is surrounded on three sides with an elevated rim 51 or lip to help center their foot on the foot pads and reduce a potential for a user sliding their foot off of a step. One narrow end of each foot pad 50R and 50L is open to accommodate longer feet/shoes and make entry on the foot pads 50R and 50L easier.

The structure is supported on a "I" or "H" type frame having a front frame tube 21F and a rear frame tube 21R that are connected through a central tube 23. The ends of the front frame tube 21F and a rear frame tube 21R are shown with protective end caps 22 that enclose the ends, protect the ends and provide an anti-skid pad.

The foot pads 50R and 50L are maintained in a flat or horizontal orientation regardless of the height of the foot pads 50R and 50L. A pair of connecting rods, tubes or arm are connected to each foot pad 50R and 50L to maintain the parallel relationship of the foot pads 50R and 50L. The structure that connects each foot pad also has a pivoting bracket 34 that links the foot pads 50R and 50L so the foot pads 50R and 50L operate in opposing up and down motion. A control knob 30 is also connected to the pivoting bracket 34 to limit the maximum height or travel of the foot pads 50R and 50L.

The mini stepper 20 also has display in a display housing 40 that counts steps, floors, step rate, exercise time and can transmit exercise information using a wireless link to an application on a mobile device such as a phone, tablet or computer to track and accumulate exercise information.

Figure 3:
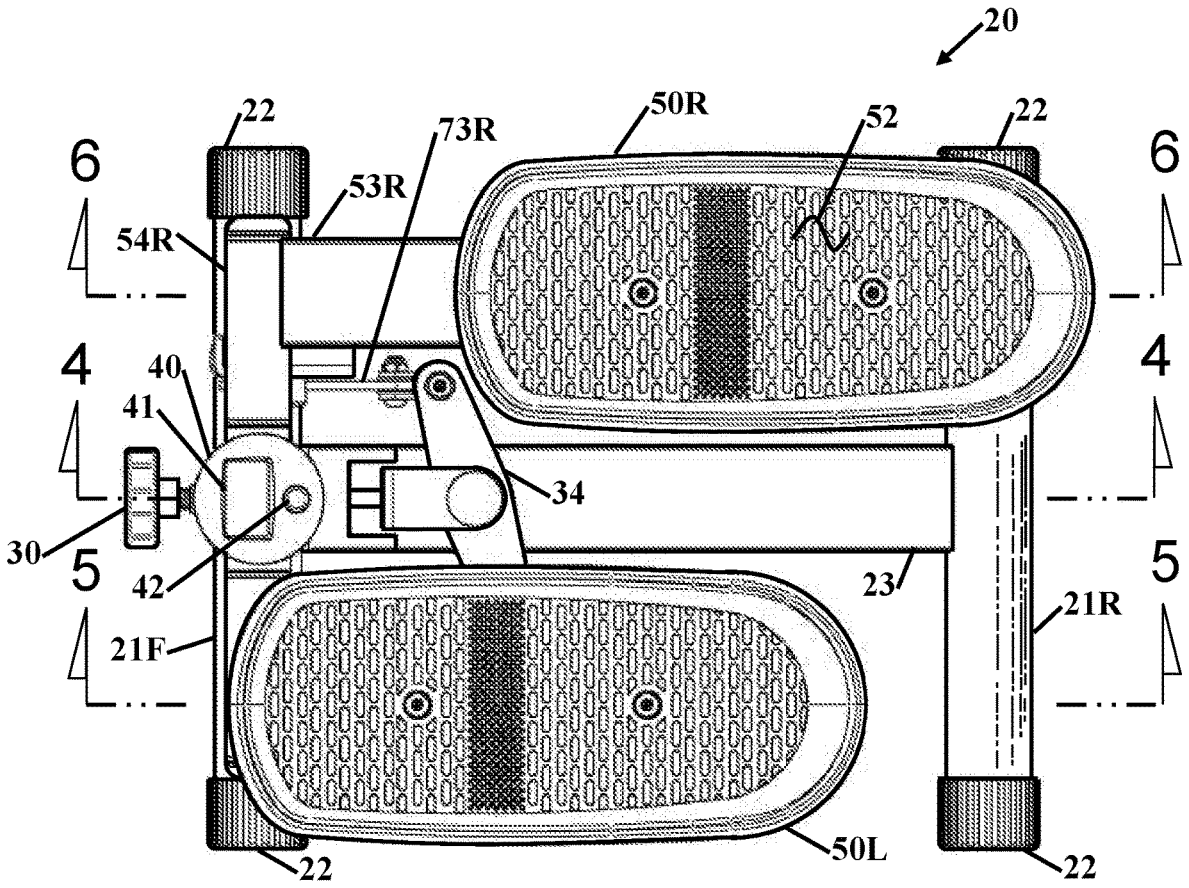
FIG. 3 shows a top view of the mini stepper.

FIG. 3 shows a top view of the mini stepper 20. From this figure the right foot pad 50R is on the lower position and the left foot pad 50L is in the elevated position. The top of each foot pad has a textured pad 52 or anti-skid pad to help maintain the position of the user's foot on the respective foot pad. From the right foot pad 50R the upper right support tube 53R is shown extending from under the right foot pad 50R where the upper right support tube 53R connects to the right pivot tube 54R. The right pivot tube 54R connects through a link 73R to the pivot bracket 34 to link both foot pads together. The pivot bracket 34 is connected to the height adjustment control 30 knob. Turning the resistance control 30 knob moves the pivot bracket closer or further from the display housing 40 to limit the vertical height travel of the foot pads 50R and 50L to change the workout intensity. It is also contemplated for the piston to have an adjustable orifice that is adjusted by turning the piston relative to the fixed shaft that changes the size of the adjustable orifice to change the resistance to compressing the piston.

The "I" or "H" type frame having a front frame tube 21F and a rear frame tube 21R that are connected through a central tube 23. The ends of the front frame tube 21F and a rear frame tube 21R are shown with protective end caps 22 that enclose the ends, protect the ends and provide an anti-skid pad. Centered in the front frame tube 21F is the display housing 40 with a display 41 and a select button 42 that allows a user to cycle through different display screens. In addition to the display 41, the mini stepper 20 has a wireless link to an application on a mobile device such as a phone, tablet or computer to track and accumulate exercise information. In this figure several section lines are shown to provide more detailed views of the mechanical interaction of the mini stepper 20.

Figure 4:
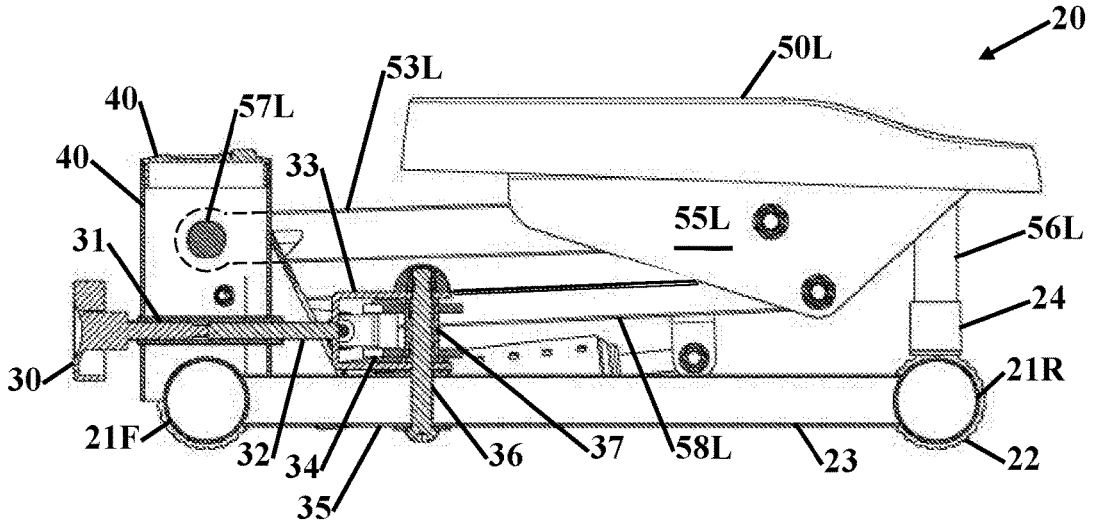
FIG. 4 shows a sectional view of the mini stepper taken along line 4-4 from FIG. 3.

FIG. 4 shows a sectional view of the mini stepper 20 taken along line 4-4 from FIG. 3. This figure shows the link mechanism that links between each foot pad to operate each foot pad to raise and lower each foot pad in an opposing relationship. The link also allows the user to limit the maximum elevation height of the foot pads to alter the workout intensity. For orientation purposes, the front frame tube 21F is shown to the left of this view, the rear frame tube 21R is shown to the right, and the tubes are connected with the central tube 23.

The right foot pad 50L is shown secured onto a left foot pad support 55L. The upper left support tube 53L and the left control arm 58L connect the left foot pad support 55L through pivot points at a first end and to pivots in the display housing 40 at a second end. The tube of the left pivot shaft 57L is identified herein. A coupling connects the left control arm 58L to a pivot bracket 34 that connects through the display housing 40 to an opposing linkage of the right foot pad (not shown in this figure). The pivot bracket 34 connects to a "U" bracket 33. The "U" bracket 33 is centered with a bushing or bearing 37 on a pivot shaft 36. The pivot shaft 36 moves linearly within a slot 35.

The "U" bracket 33 has a pull/push shaft 32 that is controlled by the resistance control 30. The resistance control 30 is essentially a threaded shaft that threads into a threaded tube 31. As the resistance control 30 is turned it will push or pull on the "U" bracket 33 to limit the uppermost position of the foot pads. Because the lowest position of the footpads is constrained by the right, or left footpad support 56L and the cushion 24 that is stopped by the rear frame tube 21R, the resistance control 30 only limits the vertical travel of the foot pads.

In the preferred embodiment the difference between the lowest foot pad position and the highest foot pad position is about 2 to 10 inches of travel, but other travel heights are contemplated beyond 10 inches. For transportation the resistance control 30 can be set so both foot pads can rest with the cushion(s) 24 on the rear frame tube 21R. In this position there is essentially no travel to the footpads.

Figure 5:
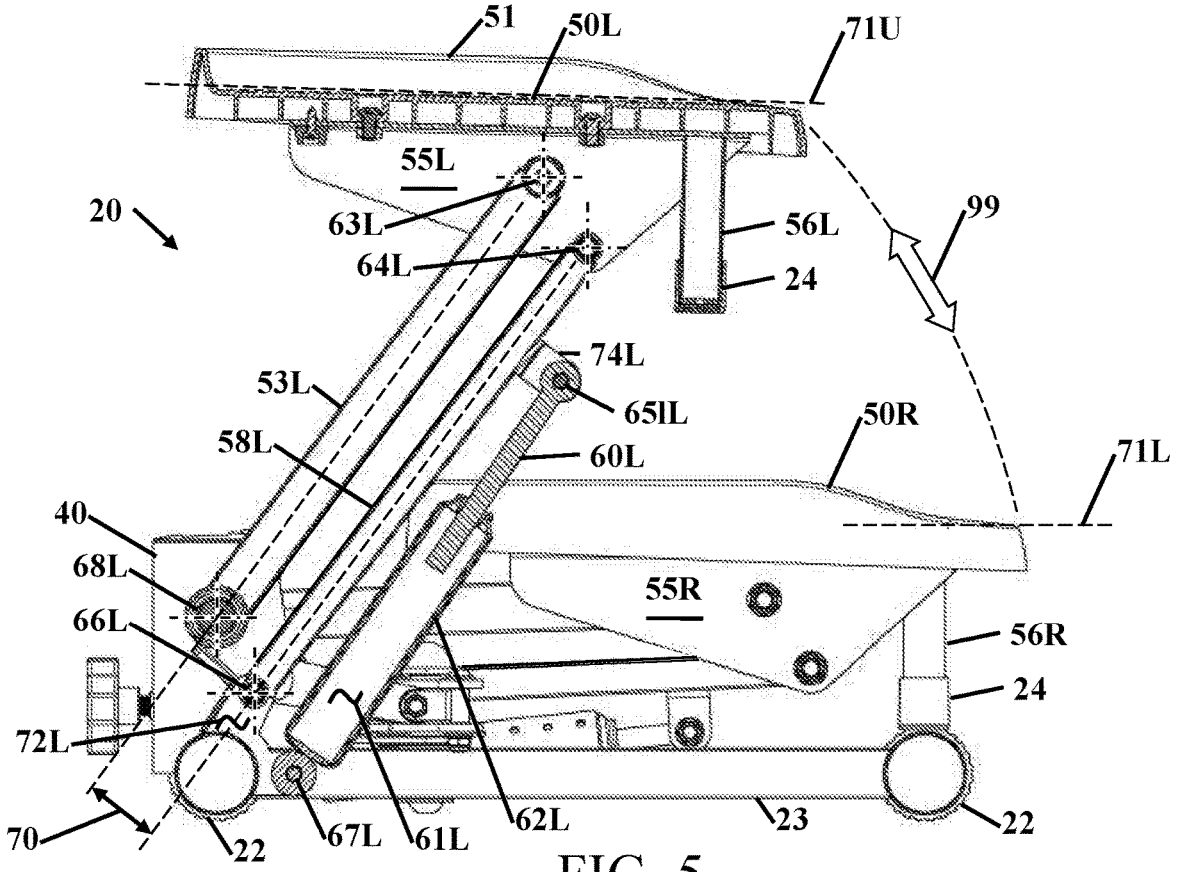
FIG. 5 shows a sectional view of the mini stepper taken along line 5-5 from FIG. 3.
Figure 6:
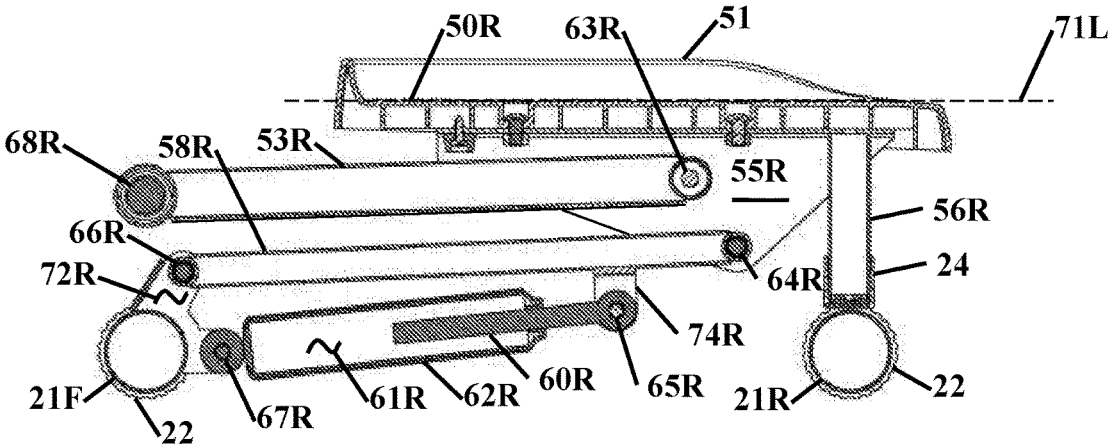
FIG. 6 shows a sectional view of the mini stepper taken along line 6-6 from FIG. 3.

FIG. 5 shows a sectional view of the mini stepper taken along line 5-5 from FIG. 3 and FIG. 6 shows a sectional view of the mini stepper taken along line 6-6 from FIG. 3. While FIG. 5 shows the left foot pad 50L in the uppermost position or upper level 71U, FIG. 6 shows the right foot pad 50R in the lowermost position or lower level 71L. These two views show the extreme positions of the foot pads. It should be understood that while each footpad is shown in a particular raised or lowered position the footpads and linkages can be moved to either extreme position or at any intermediate position as the foot pads follow a step arc 99 when using the mini stepper 20. The parallel spacing 70 or relationship of the support arms and the control arms maintain the footpads essentially level through the step arc 99 travel of the footpads.

These cross sections also show the elevated rim 51 as it passes around the sides and front of the footpads. The structure is supported on an "I" or "H" type frame having a front frame tube 21F and a rear frame tube 21R, that are connected together through a central tube 23. The ends of the front frame tube 21F and a rear frame tube 21R are closed with endcap(s) 22.

The lowest position of the footpads is constrained by the right, or left footpad support 56L or 56R. The cushion 24 is stopped by the rear frame tube 21R. The resistance control 30 only limits the vertical travel of the foot pads. The right foot pad 50R is shown secured onto a right foot pad support 55R, while the left foot pad 50L is shown secured onto a left foot pad support 55L.

The upper right support tube 53R and the right control arm 58R connect the right foot pad support 55R through pivot points 63R and 64R at a first end on the right foot pad 55R and to pivots 68R and 66R at a second end in the display housing 40. A similar relationship exists in for the links to the left footpad 50L.

Each respective left control arm 58L and right control arm 58R connects through a pivot 66L or 66R on a respective right bracket 72R or left bracket 72L. The respective right bracket 72R or left bracket 72L connects through a pivot 67L or 67R to a respective resistance air cylinder or right piston 61R or left piston 61R. The right piston rod 60R connects though a pivot 65R on a right bracket 74R that is secured to the right control arm 58R. Equivalently, the left piston rod 60L connects though a pivot 65L on a left bracket 74L that is secured to the left control arm 58L. The opposing ends of the left control arm 58L and the right control arm 58R connect with pivots 64L and 64R on their respective left or right foot pads supports 55L, 55R.

The right piston 61R or left piston 61R are each surrounded by a right piston shield 62R or left piston shield 62L. The piston shields provide user protection from hot pistons where the heat is caused by resistance to extending and retracting the piston during exercise. The shields reduces the risk from a user being burned or injured when transporting the mini stepper after or during a workout.

Figure 7:
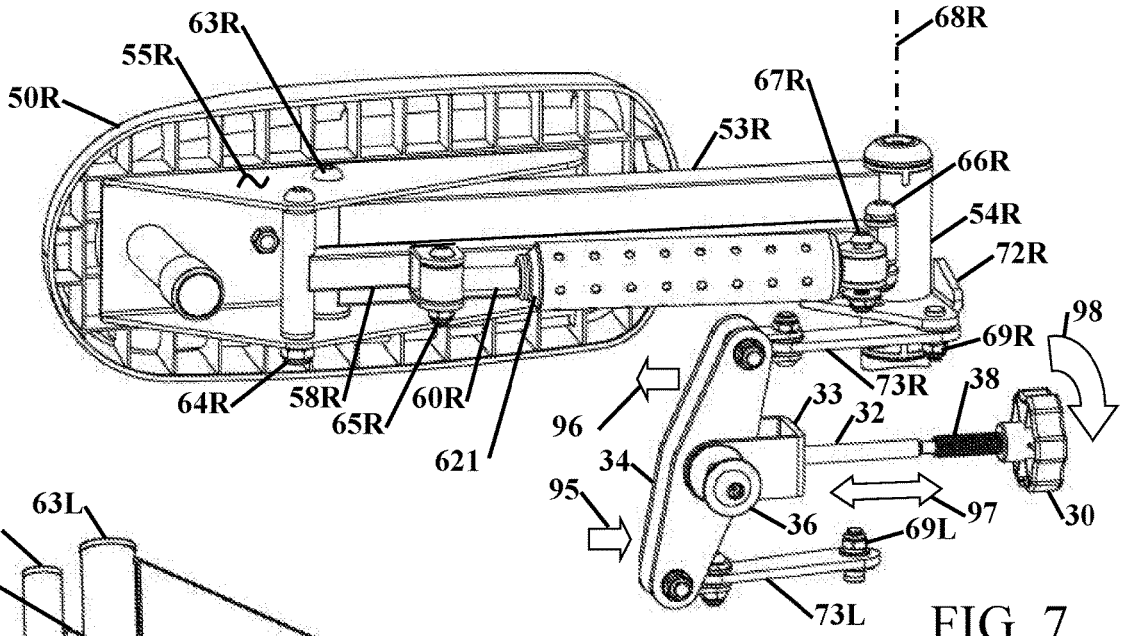
FIG. 7 shows a lower perspective view of the pedal link of the mini stepper.
Figure 8:
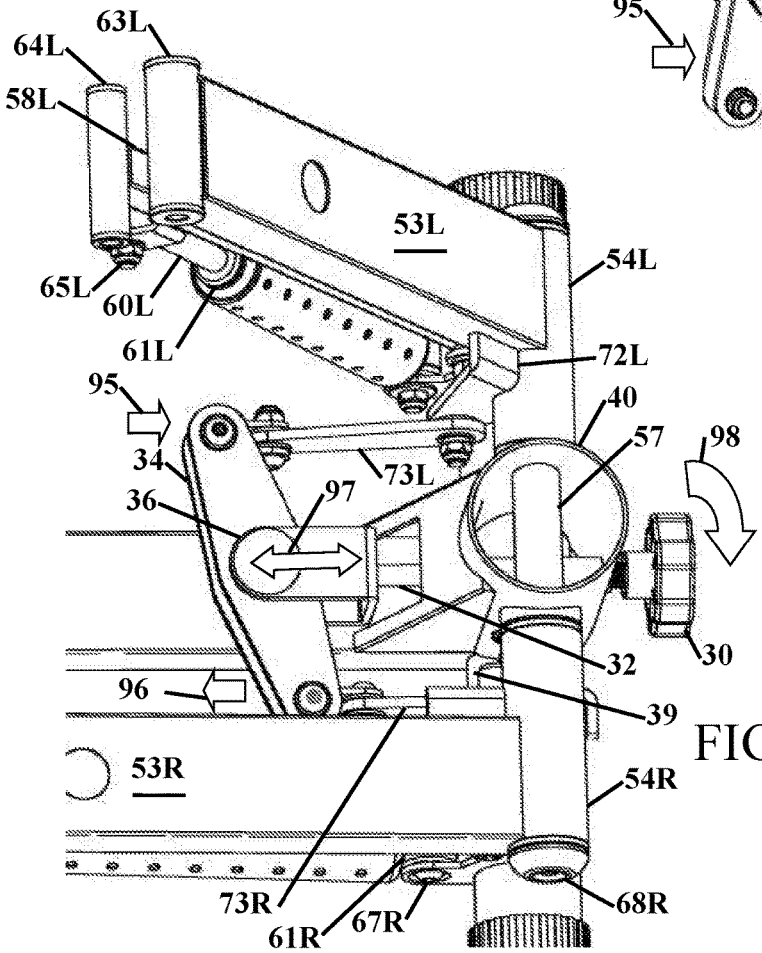
FIG. 8 shows a top perspective view of the pedal link of the mini stepper.

FIG. 7 shows a lower perspective view of the pedal link of the mini stepper and FIG. 8 shows a top perspective view of the pedal link of the mini stepper. The footpads and the step height control, is from turning or rotating 98 the resistance control 30 knob. The shaft of the resistance control 30 knob is threaded 38 into the display housing 40. This will move 97 the push/pull shaft 32 that moves the "U" bracket 33. The pivot bracket 34 can pivot in 95 or out 96 on pivot shaft 36. The position of the "U" bracket 33 changes or limits the maximum height for the foot pads, such as right footpad 50R. In the preferred embodiment, the difference between the lowest foot pad position and the highest foot pad position is about 2-10 inches of travel, but other travel heights are contemplated beyond 10 inches. The lowest position of the footpads is constrained by the right, or left footpad support 56L or 56R and the cushion 24 that is stopped by the frame tube. The resistance control 30 only limits the vertical travel of the foot pads.

The pivot bracket 34 connects with a right link 73R to a right bracket 72R and a left link 73L that connects to a left bracket 72L through pivot 69R or 69L. Each respective bracket 72L or 72R is welded or otherwise secured to their respective left pivot tube 54L, upper left support tube 53L or right pivot tube 54R, upper right support tube 53R so they move or pivot as a single sub assembly on pivots 68L or 68R. The opposing ends of the upper left support tube 53L or the upper right support tube 53R connects with pivots 63L or 63R to foot pad support(s) 55R or 55L on footpad(s) 50R or 50L. Both the left pivot tube 54L and the right pivot tube 54R pivot or rotate on a pivot shaft 57 that passes through the display housing 40 as shown in FIG. 8 (where the display has been removed for claity).

Each control arm 58L or 58R is supported on each end with pivots 64L, 66L or pivots 64R, 66R. Each resistance piston 61L and 61R is supported on the piston body end on pivots 67L, 67R and on the piston rod end 60L, 60R on pivots 65L and 65R. Steping or cycling of the foot pads is counted with a sensor 39 that is connected to the display or a transmitter that sends the step information through a wireless link to an application.

Figure 9:
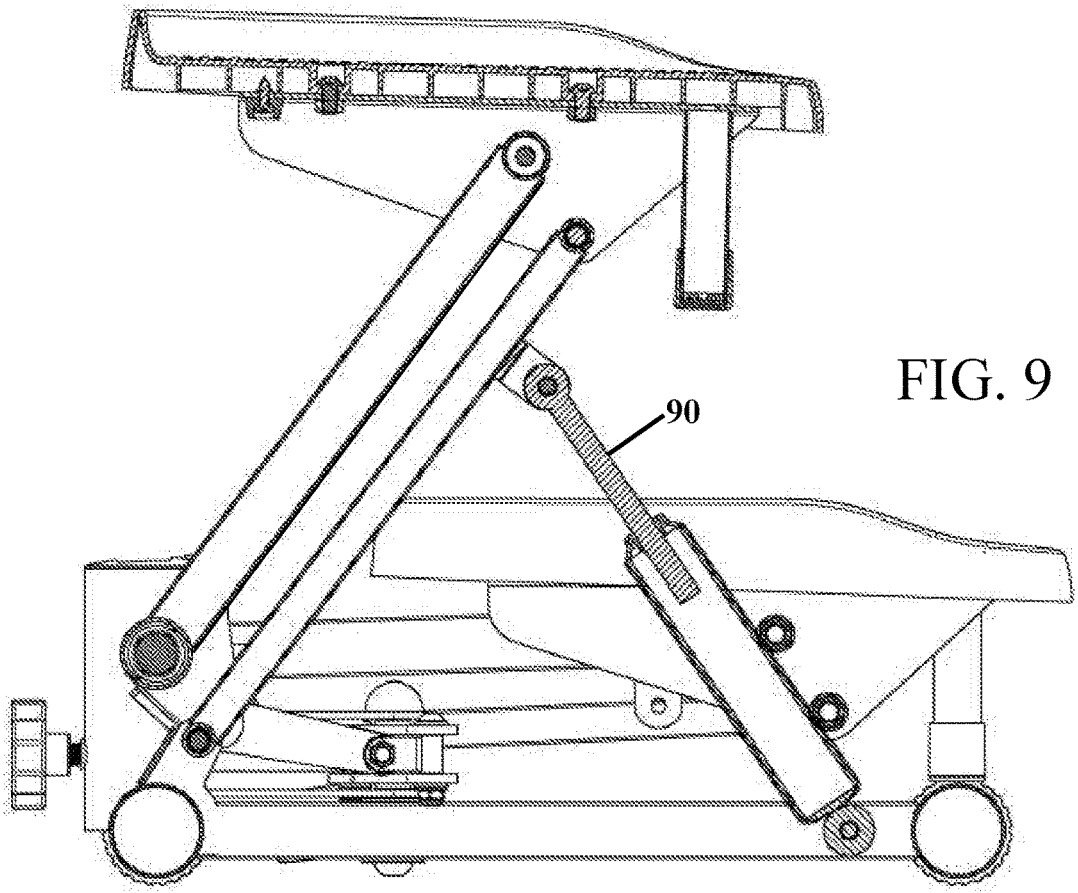
FIG. 9 show a second embodiment of the resistance piston location.
Figure 10:
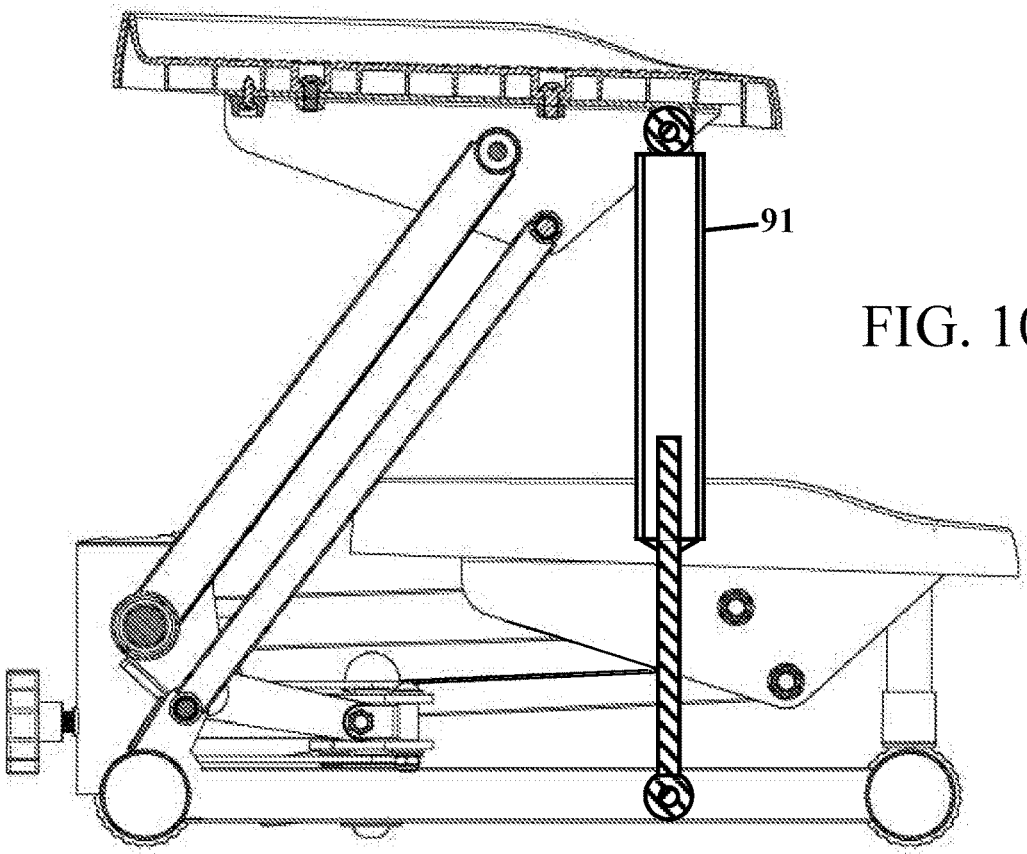
FIG. 10 show a third embodiment of the resistance piston location.

FIG. 9 show a second embodiment of the resistance piston 90 location and FIG. 10 show a third embodiment of the resistance piston 91 location this third embodiment also shows the piston in and inverted orientation.

Thus, specific embodiments of a mini stepper with flat steps have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A mini stepper with flat steps comprising:

a base frame having a central tube with a front frame tube and a rear frame tube;

a shaft that extends through a display housing;

said shaft having a left pivot tube on a left side of said central tube and a right pivot tube on a right side of said central tube;

said left pivot tube is secured to an upper left support tube at a first end of said upper left support tube and a second end of said upper left support tube is pivotally attached to a left footpad; said right pivot tube is secured to an upper right support tube at a first end of said upper right support tube and a second end of said upper right support tube is pivotally attached to a right footpad;

a left control arm is secured to said front frame tube at a first end of said left control arm and pivotally to said left footpad at a second end of said left control arm;

a right control arm is secured to said front frame tube at a first end of said right control arm and pivotally to said right footpad at a second end of said right control arm, whereby said upper left support tube and said left control arm maintain said left footpad in an essentially horizontal relationship with said base frame in a step arc of motion of said left footpad and said upper right support tube and said right control arm maintain said right footpad in an essentially horizontal relationship with said base frame in a step arc of motion of said right footpad.

2. The mini stepper with flat steps according to claim 1, wherein said step arc of motion of said left footpad and/or said step arc of motion of said right footpad is resisted by at least one piston.

3. The mini stepper with flat steps according to claim 2, wherein resistance from said at least one piston is adjustable.

4. The mini stepper with flat steps according to claim 3, wherein said at least one piston has a piston shield.

5. The mini stepper with flat steps according to claim 1, wherein said motion of left footpad and said right footpad are linked to move in opposing directions of travel.

6. The mini stepper with flat steps according to claim 5, wherein a maximum said step arc of motion of at least one of said left footpad and said right footpad is adjustable.

7. The mini stepper with flat steps according to claim 6, wherein said adjustment is by pulling or pushing on a pull/push shaft that is connected to a pivot bracket.

8. The mini stepper with flat steps according to claim 7, wherein said pivot bracket links to at least one piston and to said right control arm or said left control arm.

9. The mini stepper with flat steps according to claim 6, wherein said maximum step arc has a vertical height between said footpads of at least 10 inches.

10. The mini stepper with flat steps according to claim 6, wherein said maximum step arc has a vertical height between said footpads of less than 10 inches.

11. A mini stepper with flat steps comprising:

a base frame with a central tube;

a shaft that extends through said central tube;

said shaft having a left pivot tube on a left side of said central tube and a right pivot tube on a right side of said central tube;

said left pivot tube is secured to an upper left support tube at a first end of said upper left support tube and a second end of said upper left support tube is pivotally attached to a left footpad; said right pivot tube is secured to an upper right support tube at a first end of said upper right support tube and a second end of said upper right support tube is pivotally attached to a right footpad;

a left control arm is secured to said front frame tube at a first end of said left control arm and pivotally to said left footpad at a second end of said left control arm;

a right control arm is secured to said front frame tube at a first end of said right control arm and pivotally to said right footpad at a second end of said right control arm, whereby said upper left support tube and said left control arm maintain said left footpad in an essentially horizontal relationship with said base frame in a step arc of motion of said left footpad and said upper right support tube and said right control arm maintain said right footpad in an essentially horizontal relationship with said base frame in a step arc of motion of said right footpad.

12. The mini stepper with flat steps according to claim 11, wherein said step arc of motion of said left footpad and/or said step arc of motion of said right footpad is resisted by at least one piston.

13. The mini stepper with flat steps according to claim 12, wherein resistance from said at least one piston is adjustable.

14. The mini stepper with flat steps according to claim 13, wherein said at least one piston has a piston shield.

15. The mini stepper with flat steps according to claim 11, wherein said motion of left footpad and said right footpad are linked to move in opposing directions of travel.

16. The mini stepper with flat steps according to claim 15, wherein a maximum said step arc of motion of at least one of said left footpad and said right footpad is adjustable.

17. The mini stepper with flat steps according to claim 16, wherein said adjustment is by pulling or pushing on a pull/push shaft that is connected to a pivot bracket.

18. The mini stepper with flat steps according to claim 17, wherein said pivot bracket links to at least one piston and to said right control arm or said left control arm.

19. The mini stepper with flat steps according to claim 16, wherein said maximum step arc has a vertical height between said footpads of at least 10 inches.

20. The mini stepper with flat steps according to claim 16, wherein said maximum step arc has a vertical height between said footpads of less than 10 inches.

* * * * *